United States Patent [19]

Davis

[11] Patent Number: 5,029,873

[45] Date of Patent: Jul. 9, 1991

[54] METHOD TO DETECT IMPACTS FOR A TOY OR GAME

[75] Inventor: Steven S. Davis, Denver, Colo.

[73] Assignee: Jerry L. Davis, Denver, Colo.

[21] Appl. No.: 567,540

[22] Filed: Aug. 14, 1990

[51] Int. Cl.[5] ..... F41J 5/04; H01L 41/08

[52] U.S. Cl. ..... 273/376; 310/311

[58] Field of Search ..... 273/376, 374, 372; 310/311

[56] References Cited

U.S. PATENT DOCUMENTS

| | | | |
|---|---|---|---|
| 3,802,098 | 4/1974 | Sampson et al. | 273/376 |
| 4,651,998 | 3/1987 | Holt et al. | 273/374 |
| 4,761,005 | 8/1988 | French et al. | 273/1 GC |
| 4,824,107 | 4/1989 | French | 273/1 GC |

OTHER PUBLICATIONS

"Piezo Film Sensing Devices" Society of Manufacturing Engineers Technical Paper by William B. Powers, 11-1986.

*Primary Examiner*—Benjamin Layno

[57] ABSTRACT

An improved electronic impact detection method for the detection of an impact upon a toy or game surface. This is accomplished by the use of a plurality of flexible panels which are interconnected, with each individual target panel or region bordered with a flex barrier. The flex barriers allow the target region struck to flex under the impact of a projectile, while insulating the remaining target regions from effects of an impact. Piezo electric elements are attached to the underside of these panels, in this manner the signal produced by an impact will have sufficient strength to directly drive most digital logic integrated circuits, thereby requiring a minimum of electronic components associated with detection. These panels will also not be sufficiently triggered by common shock or sonic waves, from handling or accompanying an impact. Thereby assisting to reduce false triggerings of the target or game surface by external or undersireable elements. This method can easily be integrated into a common injection molded body and easily assembled.

1 Claim, 3 Drawing Sheets

METHOD TO DETECT IMPACTS FOR A TOY OR GAME

BACKGROUND OF THE INVENTION

1. Field of the Invention

This invention relates generally to impact detection upon a toy or game playing surface and more specifically to the electronic detection of impacts, upon a playing surface of a toy or game using piezo electric sensor elements.

2. Background-Description of Prior Art

For sometime manufactures of toys and games, have had a need for a method to detect impacts of projectile game elements such as balls, darts, etc., upon a target or game surface. Such a method should be inexpensive, of reliable function, with ease of manufacture and assembly. It is further desireable for the method to use a minimum of electronic support parts, used in accompanying electronic detection circuitry. As well it should be relatively free from false detection due to extraneous causes such as shock Many attempts of solving this need have used piezo electric sensor elements in a detection role. However the manner in which they are used does little to satisfy the needs set forth. Some examples of prior art methods using piezo electric sensor elements are set forth in the patents briefly described below.

The Landsman U.S. Pat. No. 4,822,042 and the Scharer U.S. Pat. No. 4,361,330 shows the use of piezo electric sensor elements to detect impacts upon a game surface or target. These are used as shockwave detectors, with support electronic circuitry to determine its approximate impact upon a target or game surface location Basic X-Y vector components are provided by the difference in time that it takes the shock wave or sonic wave to travel to each of the few sensors. This method usually requires sensor amplification to attain usable signal levels. This method becomes very suceptable to false triggerings, due to extraneous vibrations from handling or impacts themselves.

The Conrey U.S. Pat. No. 4,101,132 and the Bon U.S. Pat. No. 4,029,315 both show the use of piezo electric sensors utilized to measure the change in tension in a cable member, connected to the target. Which in conjunction changes in response to a projectile stiking the target or game area. Again the difference in time required to trigger the sensors upon the cable elements, is used to determine an approximate X-Y coordinate upon the target or game surface. These systems also usually require sensor amplification to get the sensor signals to levels useable by a detection circuit. These systems would most likely be susceptible to cable element load variances and binding, as well as cable element elasticity, both of which can cause detection errors. These systems should also be susceptible to false triggerings, by sonic vibrations and handling.

In the afore mentioned Patents the methods of detecting impacts specifies that it uses the onset of the shock or sonic waves through the material to the closest sensor element. From there further sensor elements detect the shock or sonic wave, as it moves away from the impact thus determining the distance from each sensor, thereby being able to determine the approximate location of the impact. My method uses the uniform inward compression of a region and thereby the uniform inward compression of an attached piezo electric sensor element. This signal is considerably stronger and thereby more uniform and reliable. An intuitive understanding of the two different components is; if you take a piece of paper and bend it, you can simultaneously instigate a shock or sonic wave through it while not affecting the bending of the paper. While the above Patents utilize the measurement of the shock or sonic waves, my method utilizes the uniform bending of the piezo electric sensor elements. A piezo electric sensor element produces electrical energy by a simple bending of its structure, the greater and more uniformly you can bend it, the larger the electrical signal it will produce. A shock wave produces a sinusoidal motion through a surface. This causes some of the piezo electric sensor element to be bending in the opposite direction shortly after the shockwave begins to effect the piezo electric sensor element. Thereby producing a signal that is relatively small, because negative and positive signals present in the sensor are summed up. This produces only a signal that is as large as the amount of the summed signal components, taking place in the sensor element, as the shock wave strikes the piezo electric sensor element and moves through it. My method is superior since it uses an entire compression of the piezo electric sensor in one direction, this causes a much larger signal. Which is more reliable for detection, while being relatively immune to false triggerings from shock waves. This is further enhanced, because as an impact takes place upon my design, the panels which are not struck bend outwardly as a reaction to the impact. This produces a signal that is of opposite polarity to that of the impacted sensors signal. These panels then vibrate back and forth from being impacted producing a mechanical oscillation that diminishes rapidly, with resultant signals coming from each panel. Using my method, the impact generated shock waves have little effect upon the detection method, as the signals produced by such shock waves are not of sufficient levels to trigger the electronics typically used in my method.

The French U.S. Patent Nos. 4,761,005 and 4,824,107 show the use of piezo electric film used as sensors, in foam garments to detect impacts generally upon various parts of the body. The sensor utilizes a compressive or bending motion in this embodiment, in which to produce an electric signal from the piezo electric film. However it uses a good deal of distance in which to separate the strike areas from other strike areas or non-detection areas. Without the benefit of a flex barrier as my method incorporates, the foam garments they utilized when impacted in a target or non target area and the bodies reaction to the impact, will cause considerable bending and creasing of the garment in the target areas. This will cause the piezo film to also bend and crease and will result in false triggerings from the piezo electric film sensors.

SUMMARY OF THE INVENTION

Whatever the precise merits, features, and advantages of the above cited references, none of them as efficiently achieves and fulfills the purposes of the present impact detection method, in the same manner. Accordingly, it is a principal object of the present invention to provide a simple detection method using piezo electric sensor elements, which is reliable, rugged, and relatively immune from sonic waves caused by non-game element impacts or sonic vibrations from impacts. Preferably the method should provide for a target or game surface or body that is easy to manufacture and assemble and provide for a minimum of electronic detection components.

This invention accomplishes these objectives by the use of a plurality of flexible panels which are interconnected, with each individual target region bordered with a flex barrier. The barriers allow the target regions struck to flex under the impact of a projectile, while insulating the remaining target regions from the effects of an impact. When piezo electric sensor elements are used on target or game panels in this manner. An impacted panel provides an optimum bending or deformation of the associated piezo electric sensor element, thereby producing an optimum electrical signal. Generally, common shock or sonic waves from handling or accompanying an impact will not produce a sufficient signal to trigger the simple electronic detection circuitry used in this method. Thereby assisting to reduce false triggerings of the target or game surface by external or undersireable elements. This method can easily be integrated into a common injection molded body and assembled with little effort.

DESCRIPTION OF THE PREFERRED EMBODIMENT

Figure 1:
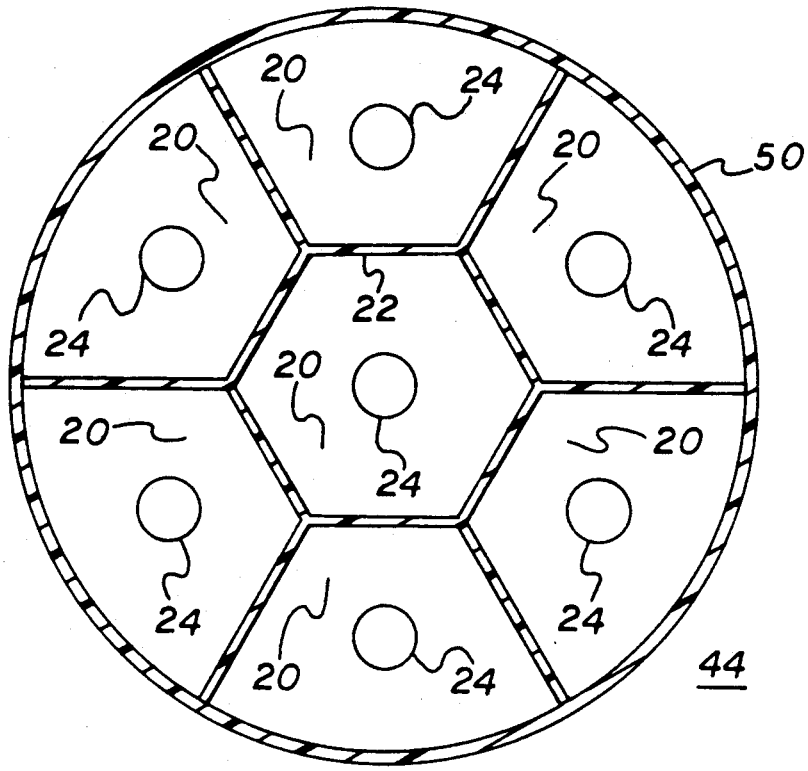
FIG. 1 is a rear view of the preferred target body of the invention, without the flex barrier support.
Figure 2:
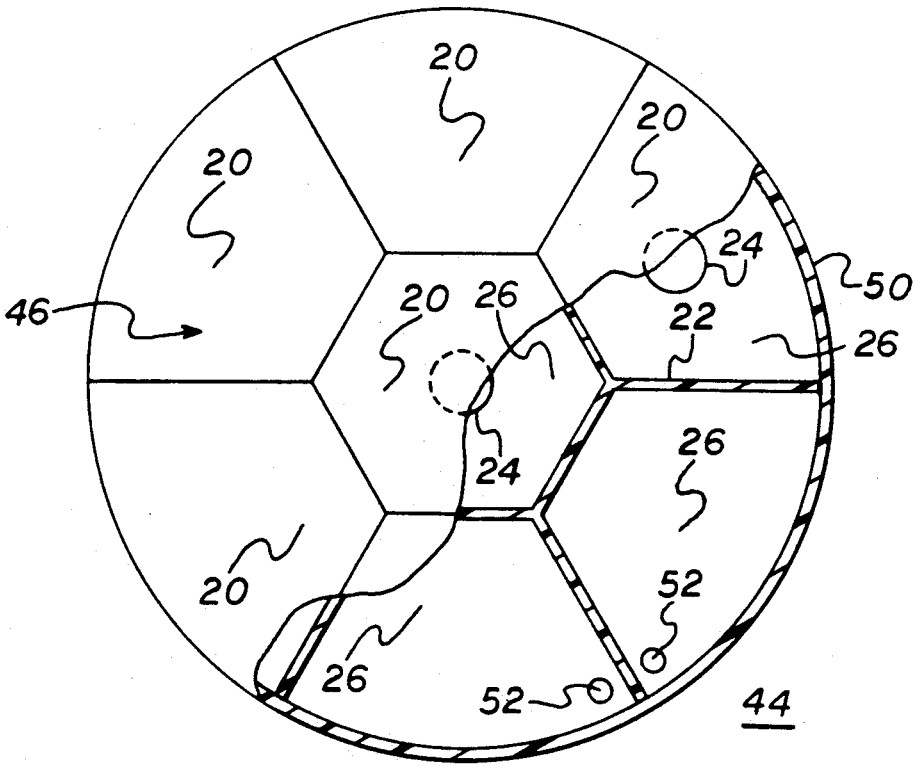
FIG. 2 is a front cutaway view of the target body of the preferred embodiment.

Generally referring now to FIGS. 1,2,3, and 4, the target body 44 comprises several sections. The target surface 46, which comprises a plurality of individual target panels 20, for the reception of a game element 32. Attached beneath and bordering each of these target panels 20 is a flex barrier 22, which is a very narrow support that protrudes away from the underside of the target panels 20. The flex barrier 22 should provide sufficient depth to allow the target panels 20 and their piezo electric sensor elements 24 to flex unimpeded by the flex barrier support 26, when impacted. The target panels 20 and the flex barrier 22 should be made from a pliable material such as wood or plastic and attached to each other so that the flex barriers 22 correspond to desired target regions. Alternatively they can more simply be made as a single plastic injection molded piece. Attached to the underside of each target panel 20, in a generally centered location is one or more piezo electric sensor elements 24, commonly available. Attached to the flex barrier 22, opposite the side of the target panels 20 is the flex barrier support 26, which is a flat member that assists in providing rigidity and closure to the target body 44. The flex barrier support 26 may be constructed of any of a number of materials such as wood, plastic, or metal to provide rigidity and support to the target body 44. Around the exterior edge of the target body 44 is the target body frame 50, which a generally thicker and more resilient member of the flex barrier 22. This member acts as a flex barrier around the perimeter and can provide support for the attachment of a stand or handle as determined by a specific design. The target body frame 50 should be constructed of the same material as the flex barrier 22 and aids in the rigidity and durability of the target body 44. Through out the target body 44, the flex barrier support 26 will have to have appropriate apertures 52, through which will pass the sensor connecting leads. These will run to the location of the impact detection electronic circuitry.

Figure 5:
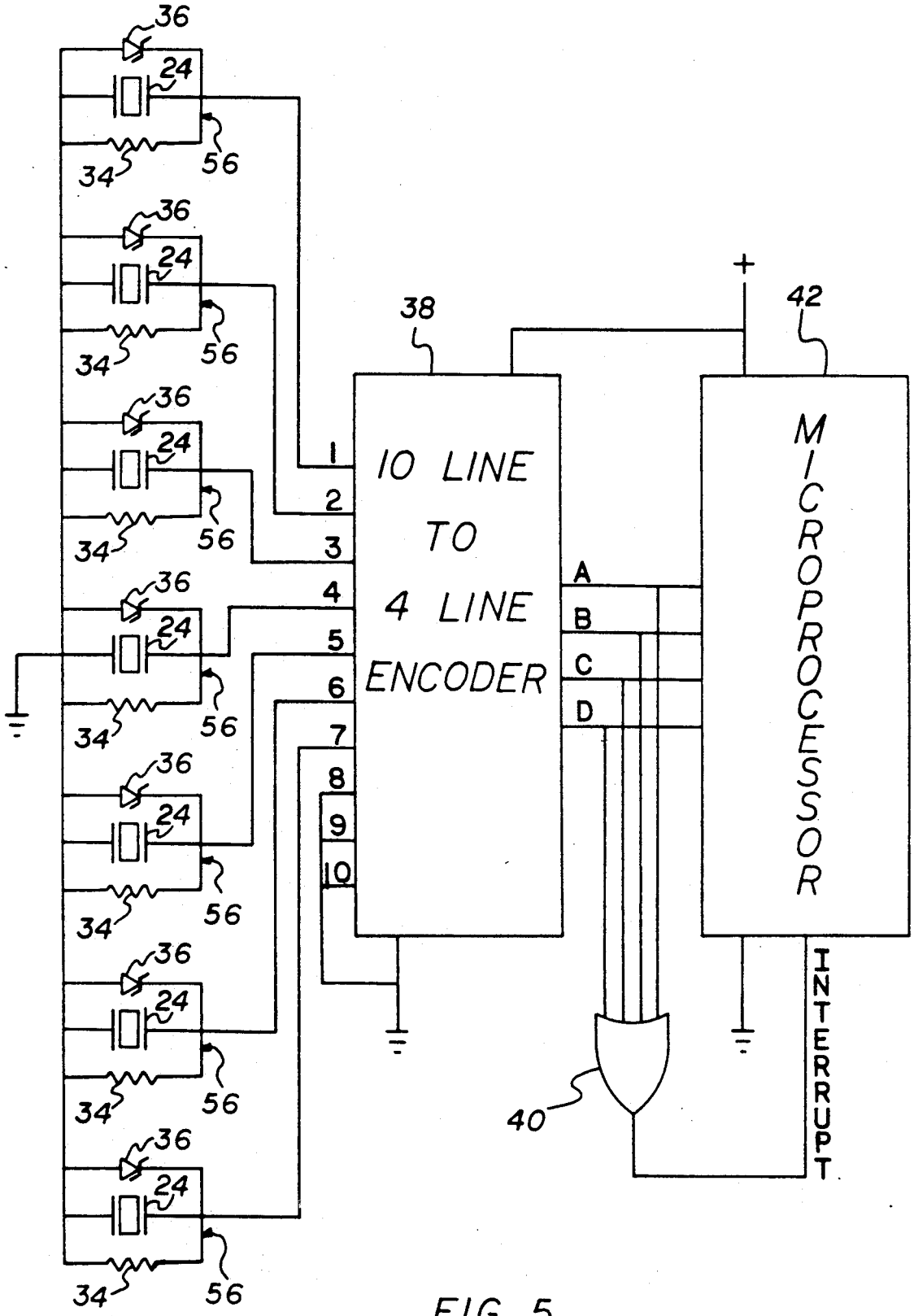
FIG. 5 is a detailed schematic diagram of the circuitry employed in the preferred embodiment.

Generally referring now to FIG. 5, a sample of a typical electronic circuit for use by a microprocessor is illustrated. The piezo electric sensor elements 24 are shown connected in parallel with resistive elements 34 and zener diode elements 36, this forms sensor group 56. One lead of this sensor group 56 is connected to the circuit ground and the other is connected to one of the logical inputs of a typical 10 line to 4 line BCD encoder 38, common to the electronic digital logic field. The four BCD outputs of the 10 line to 4 line BCD encoder 38 are connected to the inputs of a microprocessor 42 and the inputs of a 4 input OR gate 40. The output of OR gate 40 is connected to one of the interrupt input terminals of the microprocessor 42. From this point the further extent of the circuitry would depend upon the specific application of a designer.

A piezo electric sensor element 24 produces electric energy by a simple bending of its structure, the greater and more uniformly you can bend it, the larger the electrical signal it will produce. My method uses the uniform inward compression of a target panel 20 and thereby the uniform inward bending of an attached piezo electric sensor element 24. This signal is considerably strong and uniform and thereby more reliable.

Figure 4:
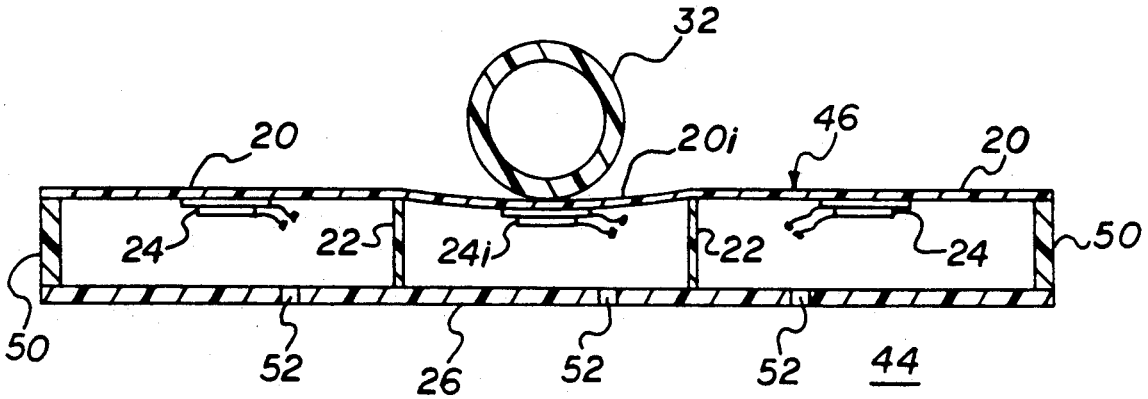
FIG. 4 is a cross-sectional view of the target body showing the components of the target body and the deformation of one of the target panels by a game element.

The conventional piezo electric sensor elements 24 are attached to the underside of the material comprising the target surface 46, with the appropriate polarity for the detection circuitry. An individual piezo electric sensor element 24 is positioned in a generally central location with respect to each of the target panels 20, whose bounderies are determined by the shape and location of the target body frame 50 and or flex barrier 22. The target body frame 50 and or flex barrier 22 allows only the impacted area to flex inward or in a concave manner as illustrated in FIG. 4 by the flexing panel 20*i*, when impacted by a game element 32. As this inward flexing is taking place the attached piezo electric sensor element 24*i* is also flexing in an inward or concave manner. As the piezo electric sensor element 24*i* is flexing uniformly inward from the impact, it produces a positive beginning signal large enough to exceed the trigger levels in most common digital logic integrated circuits. Simultaneously as this target panel 20*i* is flexing inward in a concave manner, the non-impacted target panels 20 will flex outward slightly in a convex manner as a result of the collision with the game element 32. Their associated piezo electric sensor elements 24 will produce a smaller signal, which is beginning in opposite polarity to that of the impacted target panel 20*i*. It is the function of the resistive elements 34 and zener diode elements 36 to assist in conditioning the electronic signal from the impacted piezo electric sensor elements 24*i* to levels typically suitable to directly trigger many different digital logic integrated circuits, such as a 10 line to 4 line BCD encoder 38. The resistive elements 34 and zener diode elements 36 also provides overvoltage protection to these digital logic components in the event that they were not incorporated with them by the manufacture. Once a signal exceeds the trigger level of a digital logic component such as the 10 line to 4 line BCD encoder 38. The 10 line to 4 line BCD encoder 38 outputs the associated signal to the microprocessor 42 inputs and also to the 4 input OR gate 40. When this signal reaches the OR gate 40 it inturn outputs a signal to one of the microprocessors 42 interupt inputs. As the microprocessors 42 receives this interrupt signal it will initialize its software. The microprocessor 42 should have software that when initialized will allow and store the input available from the four BCD lines, output from the 10 line to 4 line BCD encoder 38. From this point it would be up to the designer of the individual system as to how these signals are further used or displayed. Generally there will have to be a short period immediately following the detection of the impact signal, that the circuitry or software ignores further signals from any of the piezo electric sensor elements 24, for a period of approximately 100–400 milliseconds. This is so that the target panels 20 can regain flexing equilibrium and thereby not produce extraneous signals.

Figure 3:
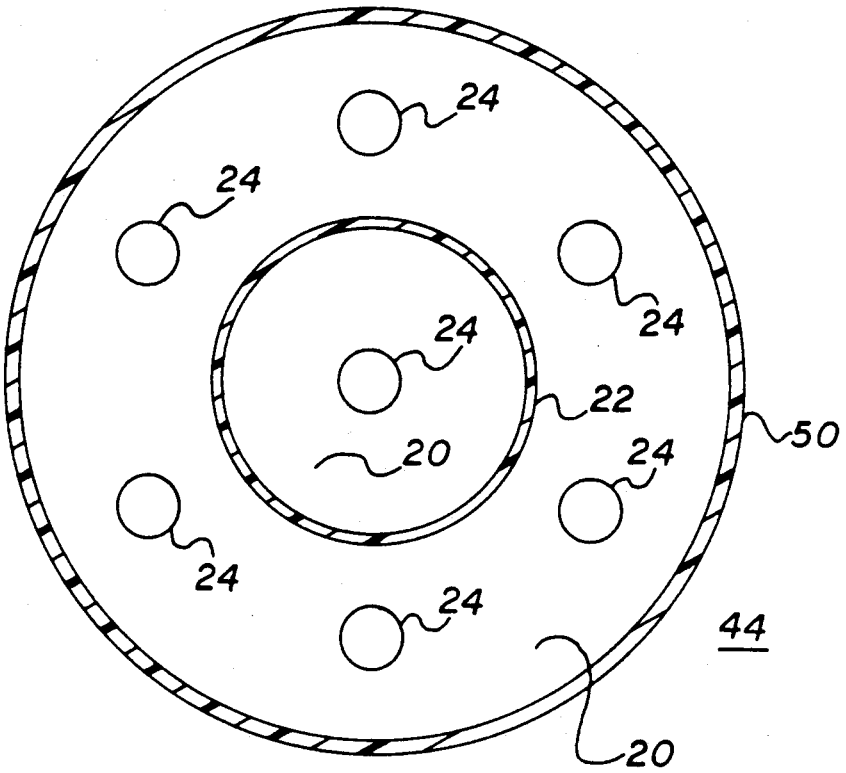
FIG. 3 is a rear view of an alternative target body without the flex barrier support, employing a plurality of sensors for the panels.

Referring now to FIG. 3, illustrating how a target body 44 may employ a plurality of piezo electric sensor elements 24 to adequately equip a target panel 20, for impact detection. The elements should be arranged around the specific target panel 20, so that an impact upon the target panel 20 will provide a sufficient inward or concave flexing of at least one piezo electric sensor element 24, to trigger the attached digital logic electronic components such as the 10 line to 4 line BCD encoder 38.

Thus the reader will see that the improved impact detection method, by the use of piezo electric sensor elements 24 attached to flex isolated panels 20 provides a simpler, reliable, inexpensive, yet easy to use in manufacture; method of impact detection upon a toy or game surface or as synonymously referred to in the description as a target surface 46. Which requires a minimum of detection support electronic components and while providing excellent immunity to shock or sonic wave interference prevalent in the prior art.

While my above description contains many specificities, these should not be construed as limitations on the scope of the invention, but rather as an exemplification of one preferred embodiment thereof. Many other variations are possible. For example this method may be used to construct small battery powered games resembling for instance skeeball. It may also be used on rackets or paddles, to produce a variety of hand held action games and it can be utilized in pinball, darts, or golf target games. As well this method can also be used in firearm targets. The signals generated from impacts with the panels could further be used to assist in determining the kinetic energy of a projectile, if desireable. Accordingly, the scope of the invention should be determined not by the embodiments illustrated, but by the appended claims and their legal equivalents.

I claim:

1. A method of detecting an impact of a game element upon a toy or game target which comprise a flexible target board having an outer surface and an inner surface, a plurality of rigid interconnected barrier panels, said barrier panels perpendicularly attached to said inner surface of said target board, said barrier panels divide said target board into a plurality of flexible target panels, wherein said barrier panels define the boundaries of said target panels, a rigid barrier board perpendicularly attached to said barrier panels and positioned behind or beneath said target board, a plurality of piezo electric sensor elements attached to the inner surface of each of said target panels, and a processing means electrically connected to said sensor elements, said method comprising the steps of:

projecting a game element toward said target board, said game element impacting the outer surface of a target panel, said impacted target panel flexing inward in a concave manner as a result of the impact with said game element, the piezo electric sensor element attached to the inner surface of said impacted target panel also flexing inward producing an electronic signal of a specific polarity, simultaneously, said barrier board and said barrier panels remaining rigid while the remaining non-impacted target panels flexing outward in a convex manner as said non-impacted target panels resist the change in motion imparted by said impact, the piezo electric sensor elements attached to the inner surface of each of said non-impacted target panels also flexing outward producing an electronic signal of a polarity opposite to that produced by said impacted target panel's piezo electric sensor element, said processing means receiving and processing said signals for indicating the impact on said impacted target panel.

* * * * *